US007078958B2

(12) United States Patent
Gower et al.

(10) Patent No.: US 7,078,958 B2
(45) Date of Patent: Jul. 18, 2006

(54) CMOS BANDGAP REFERENCE WITH LOW VOLTAGE OPERATION

(75) Inventors: Richard Leigh Gower, San Jose, CA (US); Bhupendra Kumar Ahuja, Fremont, CA (US)

(73) Assignee: Exar Corporation, Fremont, CA (US)

( * ) Notice: Subject to any disclaimer, the term of this patent is extended or adjusted under 35 U.S.C. 154(b) by 156 days.

(21) Appl. No.: 10/364,278

(22) Filed: Feb. 10, 2003

(65) Prior Publication Data

US 2004/0155700 A1 Aug. 12, 2004

(51) Int. Cl.
*G05F 1/10* (2006.01)
*G05F 3/02* (2006.01)

(52) U.S. Cl. ..... 327/539; 323/313

(58) Field of Classification Search ..... 327/538–543; 323/312, 313, 315, 316
See application file for complete search history.

(56) References Cited

U.S. PATENT DOCUMENTS 5,666,046 A * 9/1997 Mietus ..... 323/313
6,489,835 B1 12/2002 Yu et al. ..... 327/539
6,563,371 B1 * 5/2003 Buckley et al. ..... 327/539
2002/0014914 A1 * 2/2002 Perque et al. ..... 327/543

OTHER PUBLICATIONS

Leung et al., "A Sub–1–V ppm/°C CMOS Bandgap Voltage Reference Without Requiring Low Threshold Voltage Device," *IEEE Journal of Solid State Circuits*, vol. 37, No. 4, Apr. 2002, pp. 526–530.

* cited by examiner

*Primary Examiner*—Quan Tra
(74) *Attorney, Agent, or Firm*—Townsend and Townsend and Crew LLP

(57) ABSTRACT

A bandgap reference voltage generator includes, in part, a first closed-loop circuit having a first operational amplifier and adapted to generate a first current with a positive temperature coefficient and a second closed-loop circuit having a second operational amplifier and adapted to generate a second current with a negative temperature coefficient. The bandgap reference voltage generator is further adapted to include a multitude of output stages. Each output stage may be independently scaled to sum any selected multiple of the first current to any selected multiple of the second current to generate an output voltage having either a nearly zero, a positive or a negative temperature coefficient. For example, the first output stage may be scaled to generate a reference output voltage with a nearly zero temperature coefficient. Similarly, the second output stage may be scaled to generate a reference output voltage with a negative temperature coefficient.

15 Claims, 2 Drawing Sheets

CM OS BANDGAP REFERENCE WITH LOW VOLTAGE OPERATION

CROSS-REFERENCES TO RELATED APPLICATIONS

Not Applicable

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The present invention relates to integrated circuits, and more particularly, to an integrated bandgap reference circuit operative to generate an output voltage that is adapted not to vary with temperature.

Bandgap reference voltage generators (alternatively referred to as bandgap reference circuits) are used in a wide variety of electronic circuits, such as wireless communications devices, memory devices, voltage regulators, etc. A bandgap reference circuit often supplies an output voltage that is relatively immune to changes in input voltage or temperature.

A bandgap reference circuit is typically adapted to use the temperature coefficients associated with physical properties of the semiconductor devices disposed therein to generate a nearly temperature-independent reference voltage. A bandgap reference circuit operates on the principle of compensating the negative temperature coefficient of $V_{BE}$—which is the base-emitter voltage of a bipolar transistor—with the positive temperature coefficient of the thermal voltage $V_T$. In its most basic form, the $V_{BE}$ voltage is added to a scaled $V_T$ voltage using a temperature-independent scale factor K to supply the reference voltage $V_{ref}$, as shown below:

$$V_{ref}=V_{BE}+K*V_T \tag{1}$$

Because voltage signals $V_{BE}$ and $V_T$ exhibit opposite-polarity temperature drifts, parameter K may be selected such that voltage $V_{ref}$ is nearly independent. As is known to those skilled in the art, thermal voltage $V_T$ is equal to kT/q, where, where k is Boltzmann's constant, T is the absolute temperature in degrees Kelvin, and q is the electron charge.

In addition to being temperature independent, a bandgap reference circuit is ideally also adapted to supply a substantially stable and unchanging output reference voltage despite variations in the input voltage levels received by or the capacitive loading applied to the bandgap circuit. Accordingly, an ideal bandgap reference circuit output is also immune to ripples or noise that is typically present in the power source supplying voltage to the bandgap reference circuit. However, most bandgap reference circuits exhibit non-ideal characteristics. One measure of the ability of a bandgap reference circuit to suppress or reject such supply ripple or noise voltages is referred to as the power supply ripple rejection (PSRR).

The growth in demand for battery-operated portable electronic devices, such as wireless communications devices and personal digital assistance devices, has brought to the fore need to develop low voltage, low power systems. For instance, many portable wireless systems are being designed to operate using batteries that supply, for example, 1.3 volts. Designing a bandgap reference circuit adapted to operate at such low voltages poses a challenging task.

In a publication entitled "A Sub-1-V ppm/° C. CMOS Bandgap Voltage Reference Without Requiring Low Threshold Voltage Device", IEEE Journal of Solid State Circuits, Vol. 37, No. 4, April 2002, pp. 526–530, authors Leung et al. propose a sub-1V bandgap reference voltage formed using a standard CMOS process and that dispenses with the need for low threshold voltage devices (such as those shown in FIGS. 1A and 1B of Leung et al.). FIG. 1 shows a transistor schematic diagram of the sub-1V bandgap reference circuit 10 by Leung et al.

The sub-1V bandgap reference circuit 10 includes a single loop and a single operational amplifier 12 that receives input voltages from node $N_1$ and $N_2$. Current I is generated by the closed-loop circuitry formed by operational amplifier 12, transistors $Q_1$, $Q_2$, and resistors $R_1$, $R_{2A1}$, $R_{2B1}$, $R_{2A2}$ and $R_{2B2}$. Current I has the following magnitude:

$$I=V_{EB}/R_2+V_T*\ln N/R_1 \tag{2}$$

where N is the ratio of the emitter areas of transistors $Q_1$ and $Q_2$, $V_T$ is the thermal voltage and where:

$$R_2=R_{2A1}+R_{2A2}=R_{2B1}+R_{2B2} \tag{3}$$

Transistors $M_1$, $M_2$ and $M_2$ form a current mirror. Therefore current I flowing through resistor $R_3$ is equal to the current that also flows through transistor $M_1$ or $M_2$. The reference voltage $V_{ref}$ generated by the bandgap reference circuit 10 is as follows:

$$V_{ref}=(R_3/R_2)*[V_{EB2}+(R_2R*\ln N/R_1)*V_T \tag{4}$$

Parameter N is selected such that voltage $V_{ref}$ is nearly temperature-independent. As is seen from the above, bandgap reference circuit 10 includes single closed-loop circuitry that causes the same current I to flow through output transistor M3. Therefore, if another output stage (not shown—but similar to that formed by transistor $M_3$ and resistor $R_3$) is disposed between supply voltage Vdd and the ground terminal, it will generate an output voltage with the same nearly zero temperature coefficient as that of $V_{ref}$.

There may be instances where at least two reference voltages each with a different temperature coefficient may be required. For example, to compensate for a positive temperature drift of a voltage-controlled oscillator, it may be desired to generate an output reference voltage that has a negative, non-zero temperature coefficient. Two different bandgap reference circuits 10 (i.e., with different physical parameters) would be required to generate two reference voltage that have different temperature coefficients., thereby increasing cost.

There continues to be a need for a bandgap reference circuit that is scalable and is thus adapted to generate multiple output reference voltages with each output reference voltage having a different temperature coefficient.

BRIEF SUMMARY OF THE INVENTION

A bandgap reference voltage generator, in accordance with the present invention, includes a first closed-loop circuit having a voltage-gain stage and adapted to generate a first current with a positive temperature coefficient, and a second closed-loop circuit also having a voltage-gain stage and adapted to generate a second current with a negative temperature coefficient. The bandgap reference voltage generator further includes an output stage adapted to sum any multiple of the first current to any multiple of the second current and to pass this current through an output resistor to generate an output voltage across the output resistor. The multiples are so selected as to cause the voltage across the output resistor to have a nearly zero temperature coefficient.

In some embodiments of the present invention, each of the first and second voltage-gain stages is an operational amplifier. In these embodiments, the positive and negative input terminals of the first operational amplifier are respectively coupled to nodes that receive the first current and mirrored replica of the first current. Similarly, the positive and negative input terminals of the second operational amplifier are respectively coupled to nodes that receive the second current and mirrored replica of the second current. Each of the first and second operational amplifiers provides an inverting voltage gain (i.e., as the voltage at the positive input terminal increases, the output voltage decreases and vice versa).

The first closed-loop circuit further includes, in part, a first bipolar transistor and a second bipolar transistor whose emitter are is N times the emitter area of the first bipolar transistor. The collector and base terminals of both the first and second bipolar transistors are coupled to the ground terminal. The positive input terminal of the first operational amplifier is coupled to the emitter terminal of the first bipolar transistor. The negative input terminal of the first operational amplifier is coupled to a first terminal of a resistor whose second terminal is coupled to the emitter terminal of the second bipolar transistor. Because the currents flowing through both the first and second bipolar transistors have the same magnitude and because the emitter area of the second bipolar transistor is N times the emitter area of the first bipolar transistor, and further because the voltage across the positive and negative input terminals of the first operational amplifier is nearly zero, the first current has a positive temperature coefficient.

The second closed-loop circuit further includes, in part, a bipolar transistor and a resistor. The collector and base terminals of this bipolar transistors are coupled to the ground terminal. The positive input terminal of the second operational amplifier is coupled to the emitter terminal of this bipolar transistor. The negative input terminal of the first operational amplifier is coupled to a first terminal of a resistor whose second terminal is coupled to the ground terminal. Because the currents flowing through both the first and second bipolar transistors have the same magnitude, and further because the voltage across the positive and negative input terminals of the first operational amplifier is nearly zero, the second current has a negative temperature coefficient.

The bandgap reference voltage generator is adapted to include any number of output stages. Each output stage may be further scaled to generate different multiples of the first and second currents thus to generate a reference voltage with a temperature coefficient different from those of the other stages. For example, via selection of multiples of the first and second currents flowing through a second output stage, the second output stage may be scaled to generate a reference output voltage with a positive temperature coefficient. Similarly, via selection of the multiples of the first and second currents flowing through a third output stage, the third output stage may be scaled to generate a reference output voltage with a negative temperature coefficient.

DETAILED DESCRIPTION OF THE INVENTION

A bandgap reference voltage generator, in accordance with the present invention, includes, in part, first closed-loop circuitry adapted to generate a first current with a positive temperature coefficient, and second closed-loop circuitry adapted to generate a second current with a negative temperature coefficient. The bandgap reference voltage generator is further adapted to includes a multitude of output stage. Each output stage is further adapted to sum any selected multiple of the first current to any selected multiple of the second current to generate an output voltage that has either a nearly zero, or a positive or a negative temperature coefficient. For example, the first output stage may be adapted to generate a reference output voltage that has a nearly zero temperature coefficient. Similarly, the second output stage may be adapted to generate a reference output voltage that has a negative temperature coefficient.

Figure 1:
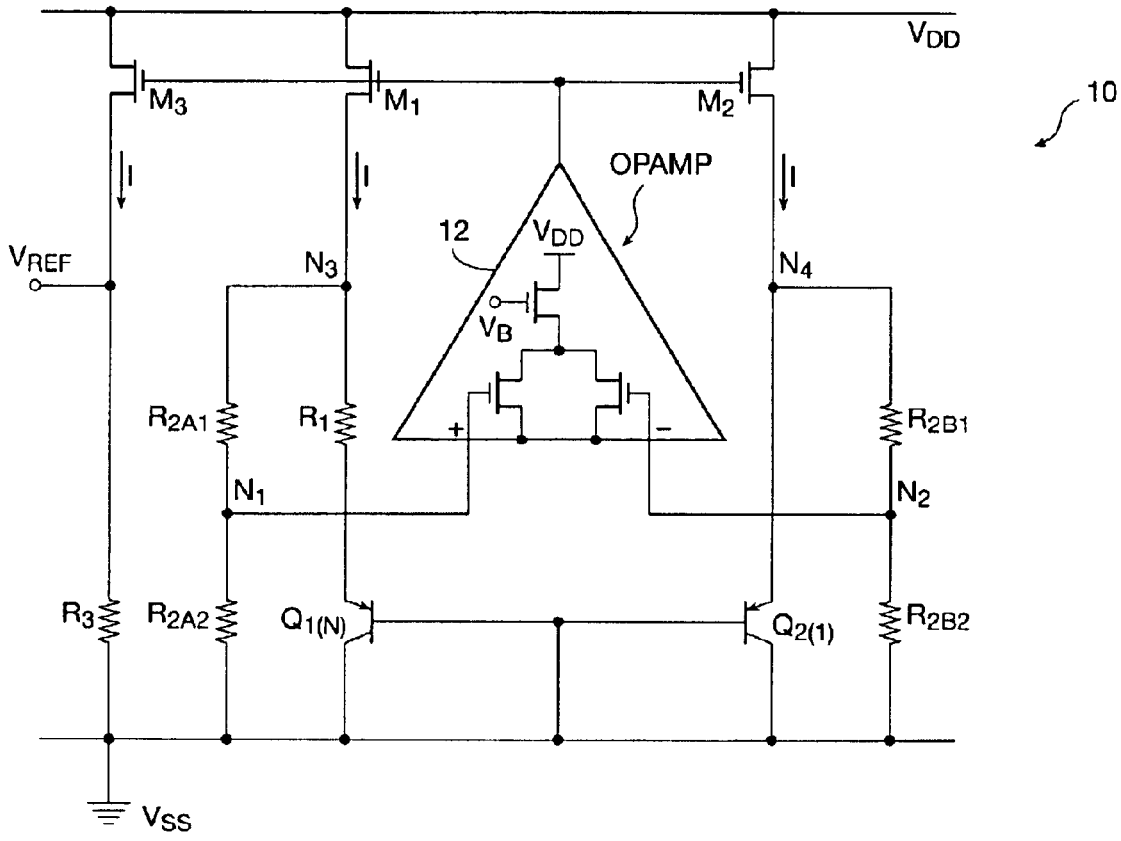
FIG. 1 (PRIOR ART)
FIG. 1 is a transistor schematic diagram of a low-voltage bandgap reference circuit, as known in the prior art.
Figure 2:
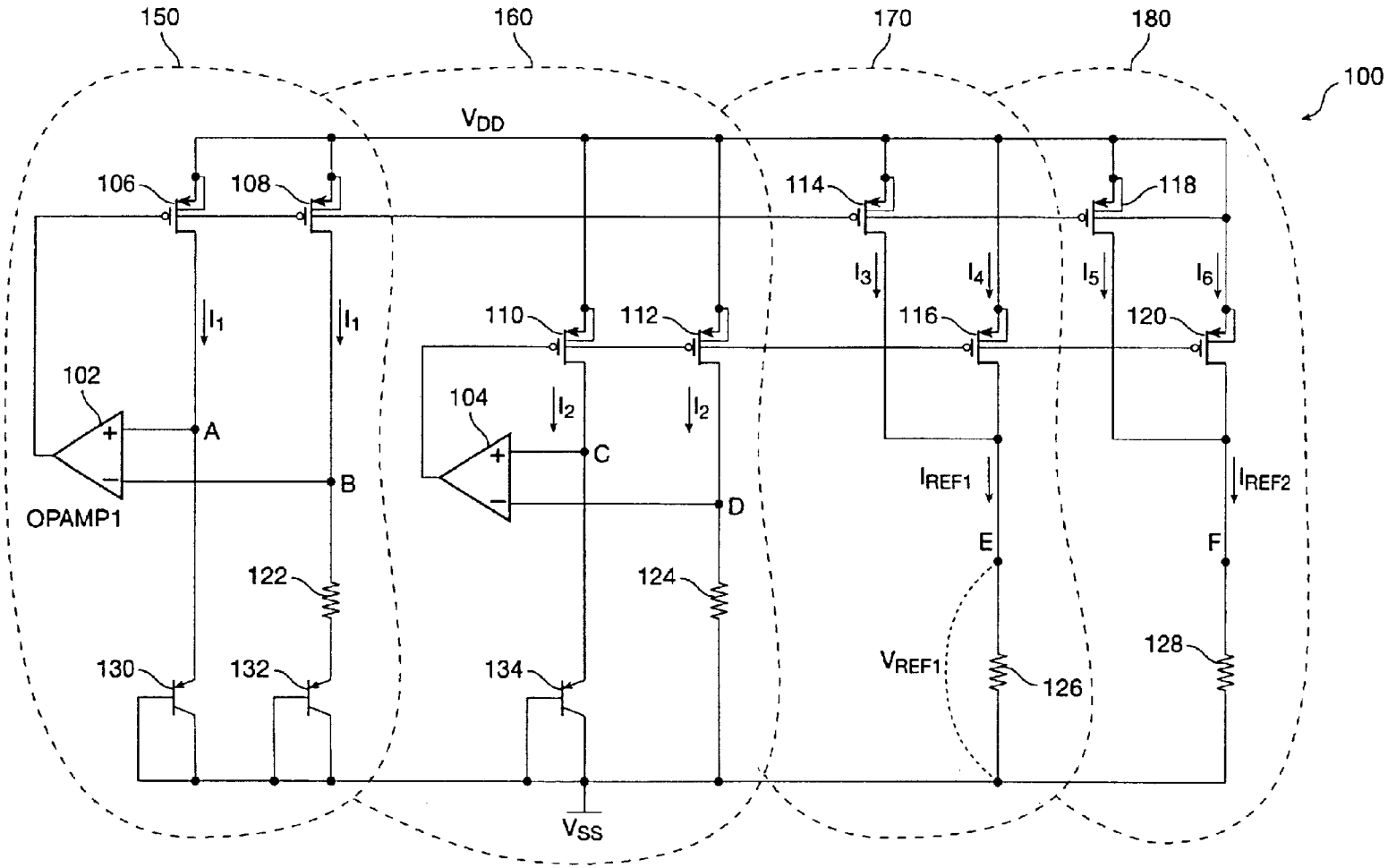
FIG. 2 is a transistor schematic diagram of a low-voltage bandgap reference circuit, in accordance with one embodiment of the present invention.

FIG. 2 is a transistor schematic diagram of a bandgap reference circuit 100 adapted to operate at voltages of 1.1 volt or greater, in accordance with one embodiment of the present invention. The exemplary embodiment of bandgap reference circuit 100 includes operational amplifiers 102, 104, P-channel MOS (i.e., PMOS) transistors 106, 108, 110, 112, 114, 116, 188, 120, resistors 122, 124, 126, 128 and PNP bipolar transistors 130, 132, 134.

The output voltage generated by operational amplifier 102 is applied to the gate terminals of PMOS transistors 106, 108, 114 and 118. Similarly, the output voltage generated by operational amplifier 104 is applied to the gate terminals of PMOS transistors 110, 112, 116 and 120. The drain terminals of PMOS transistors 106 and 108 are respectively applied to positive input terminals A and negative input terminal B of operational amplifier 102. Similarly, the drain terminals of PMOS transistors 110 and 112 are respectively applied to positive input terminal C and negative input terminal D of operational amplifier 104. Each of operational amplifiers 102, 104 provides an inverting voltage gain and is well known in the art.

Input terminal A of operational amplifier 102 is coupled to the emitter terminal of bipolar transistor 130 and the drain terminal of PMOS transistor 106. The base and collector terminals of PNP transistor 130 receive the supply voltage Vss (i.e., are coupled to the ground terminal). Input terminal B of operational amplifier 102 is coupled to a first terminal of resistor 122 and the drain terminal of PMOS transistor 108. A second terminal of resistor 122 is coupled to the emitter terminal of bipolar transistor 132. The base and collector terminals of bipolar transistor 132 receive supply voltage Vss.

Input terminal C of operational amplifier 104 is coupled to the emitter terminal of bipolar transistor 134 and the drain terminal of PMOS transistor 110. The base and collector terminals of PNP transistor 134 receive supply voltage Vss. Input terminal D of operational amplifier 104 is coupled to a first terminal of resistor 124 and the drain terminal of PMOS transistor 112. A second terminal of resistor 124 receives supply voltage Vss.

The drain terminals of PMOS transistors 114, 116 are coupled to a first terminal of resistor 126 at node E. A second terminal of resistor 126 receives supply voltage Vss. Similarly, the drain terminals of PMOS transistors 118, 120 are coupled to a first terminal of resistor 128 at node F. A second terminal of resistor 128 receives supply voltage Vss. The source terminal of each of PMOS transistors 106, 108, 110,112, 114, 116,118, 120 is coupled to supply voltage Vdd.

Operational amplifier 102 in combination with PMOS transistors 106, 108, resistor 122 and bipolar PNP transistors (hereinafter PNP transistors) 130, 132 form closed-loop 150. Operational amplifier 102 disposed in closed-loop 150 is a voltage gain stage and thus provides a voltage gain in closed-loop 150. Similarly, operational amplifier 104 in combination with PMOS transistors 110, 112, resistor 124 and PNP transistor 134 form closed-loop 160. Operational amplifier 104 disposed in closed-loop 150 is a voltage gain stage and thus provides a voltage gain in closed-loop 160.

Because the gate-to-source voltage of PMOS transistors 106 and 108 is the same, the same current $I_1$ flows through both PMOS transistors 106 and 108. As is known to those skilled in the art, the voltages at input terminals A and B of Operational amplifier (hereinafter alternatively referred to as op amp) 102 are substantially the same. Therefore, because the voltage at node A is one $V_{BE}$ above the ground potential, the voltage at node A is also one $V_{BE}$ above the ground potential. PNP transistor 132 is so adapted as to have an emitter area that is N times the emitter are of PNP transistor 130. Accordingly, because the emitter area of PNP transistor 132 is N times the emitter area of transistor 130 and because the same current flows through PNP transistors 130 and 132, and further, because nodes A and B have substantially the same voltage, current $I_1$ that flows through each of PMOS transistors 106 and 108 is defined by the following equation:

$$I_1=V_T*\ln N/R_{122} \tag{5}$$

where $R_{122}$ is the resistance of resistor 122.

Therefore, as seen from equation (5), current $I_1$ has a positive temperature coefficient. Because the gate-to-source voltage of PMOS transistors 110 and 112 is the same, the same current $I_2$ flows through both PMOS transistors 110, 112. The voltages at input terminals A and B of operational amplifier 104 are substantially the same. Therefore, because the voltage at node C is one $V_{BE}$ above the ground potential, the voltage at node D is also one $V_{BE}$ above the ground potential. Because the base-emitter voltage, i.e., the $V_{BE}$, of a bipolar transistor has a negative temperature coefficient, current $I_2$ that flows through each of PMOS transistors 110 and 112 also has a negative temperature coefficient and is defined by the following equation:

$$I_2=V_{BE}/R_{124} \tag{6}$$

where $R_{124}$ is the resistance of resistor 124.

As seen from the above, bandgap reference circuit 100, in accordance with the present invention, generates two independent currents: current $I_1$ that has a positive temperature coefficient and current $I_2$ that has a negative temperature coefficient. As described further below, currents $I_1$ and $I_2$ may be independently scaled and then combined at various output stages of bandgap reference circuit 100 to provide reference voltages with different temperature coefficient.

The exemplary embodiment of bandgap reference circuit 100 is shown as having two output stages. PMOS transistors 114, 116, together with resistor 126 form output stage 170. PMOS transistors 118, 120, together with resistor 128 form output stage 180. It is understood, however, that other embodiments of the bandgap reference circuit, in accordance with the present invention, may have more output stages. Furthermore, exemplary embodiment of bandgap reference circuit 100 is shown as having two closed loops 150 and 160 adapted to generate two independent currents. It is understood, however, that other embodiments of the bandgap reference circuit, in accordance with the present invention, may have more than two closed loops and thus may be adapted to generate more than two independent currents.

PMOS transistor 114 is adapted to have a channel-width to channel length (i.e., W/L) ratio that is $K_1$ times larger than that of PMOS transistor 106. Accordingly, current $I_3$ flowing through PMOS transistor 114 is $K_1$ times greater than current $I_1$. Similarly, PMOS transistor 116 is adapted to have a W/L ratio that is $K_2$ times larger than that of PMOS transistor 110. Accordingly, current $I_4$ flowing through PMOS transistor 116 is $K_2$ times greater than current $I_2$. Current $I_{ref1}$ flowing through resistor 126 of output stage 170 is the sum of currents $I_3$ and $I_4$ and is defined by the following equation:

$$I_{ref1}=K_1*(V_T \ln(N)/R_{122})+K_2*(V_{BE}/R_{124}) \tag{7}$$

Therefore, voltage $V_{ref1}$ developed across resistor 126 (i.e., between nodes E and the Vss) and that is a first voltage reference generated by bandgap reference circuit 100 is defined by the following equation:

$$V_{ref1}=(K_T*(V_T*\ln(N)/R_{122})+K_2*(V_{BE}/R_{124}))*R_{126} \tag{8}$$

where $R_{126}$ is the resistance of resistor 126.

As is known to those skilled in the art, resistors 122, 124 and 126 have similar temperature coefficients. Therefore, any drift in the voltage reference $V_{ref1}$ caused by variations in the resistances of resistors 122, 124 due to the temperature is offset by corresponding variations in the resistance of resistors 126. The temperature coefficients of base-to-emitter voltage $V_{BE}$ and thermal voltage $V_T$ are also known. For example, voltage $V_{BE}$ typically has a temperature coefficient of −2 mv/C° and voltage VT is equal to KT/q . Therefore, equation (9) enables parameters $K_1$ and $K_2$ to be selected such that the temperature coefficient of reference voltage $V_{ref1}$ is nearly zero.

As described further above, there may be instances where a voltage reference generated by a bandgap reference circuit is desired to have a non-zero temperature coefficient. For example, to compensate for, e.g., a negative temperature coefficient of a voltage-controlled oscillator, it may be desired to supply a reference voltage having a positive temperature coefficient. In accordance with the present invention, bandgap reference circuit 100 is adapted to generate different reference output voltages each with a different temperature coefficient. For example, as described below, bandgap reference circuit 100 is adapted to generate output reference voltage $V_{ref2}$ that has a positive temperature coefficient.

PMOS transistor 118 is adapted to have a W/L ratio that is $K_3$ times larger than that of PMOS transistor 106. Accordingly, current $I_5$ flowing through PMOS transistor 118 is $K_3$ times greater than current $I_1$. Similarly, PMOS transistor 120 is adapted to have a W/L ratio that is $K_4$ times larger than that of PMOS transistor 110. Accordingly, current $I_6$ flowing through PMOS transistor 116 is $K_4$ times greater than current $I_2$ flowing through transistor 110. Current $I_{ref2}$ flowing through resistor 128 of output stage 180 is the sum of currents $I_5$ and $I_6$ and is defined by the following equation:

$$I_{ref2}=K3*(V_T*\ln(N)/R_{122})+K_4*(V_{BE}/R_{124}) \quad (9)$$

Therefore, voltage $V_{ref2}$ developed across resistors 128 (i.e., between nodes F and the Vss) ands that is a second voltage reference generated by bandgap reference circuit 100 is defined by the following equation:

$$V_{ref2}=(K_3*(V_T*\ln(N)/R_{122})+K_4*(V_{BE}/R_{124}))*R_{128} \quad (10)$$

where $R_{128}$ is the resistance of resistor 128.

In accordance with equation (10) parameters $K_3$ and $K_4$ may be selected so that the temperature coefficient of reference voltage $V_{ref2}$ has a certain non-zero positive value, independent of the temperature coefficient of voltage $V_{ref1}$. By coupling another output stage (not shown but similar to output stages 170 and 180) to bandgap reference circuit 100 of FIG. 2, a third reference voltage $V_{ref3}$ (not shown) may be generated. By selecting the ratio of the W/L of PMOS transistors in this third output stage to those of PMOS transistors 106 and 110, the temperature coefficient of this third reference voltage $V_{ref3}$ may be set to, for example, a non-zero negative value.

Therefore, bandgap reference circuit 100, in accordance with the present invention, enables the temperature coefficients of each of its reference output voltages to be selectively varied through selection of the ratios of the W/L of PMOS transistors of its associated output stage. Moreover, the temperature coefficient of each one of the reference voltages generated by bandgap reference circuit 100 may be selected independently of the temperature coefficient of the other reference voltages generated by bandgap reference circuit 100.

The above embodiment of the present invention re illustrative and not limitative. The invention is not limited by the type of the operational amplifier, transistor, resistor, etc. disposed in the bandgap reference circuit. The invention is not limited by number of closed-loop circuits that generate currents with either positive or negative temperature coefficients. Nor is the invention limited by the number of output stages each of which may generate an output voltage having a temperature coefficient different from those of the others. Other additions, subtractions or modification are obvious in view of the present invention and are intended to fall within the scope of the appended claims.

What is claimed is:

1. An Integrated Circuit comprising:

a first closed-loop circuit having a first voltage gain stage and adapted to generate a first current having a positive temperature coefficient and a size $I_1$;

a second closed-loop circuit having a second voltage gain stage and adapted to generate a second current having a negative temperature coefficient and a size $I_2$;

a first output stage adapted to generate a third current and a fourth current, wherein the third current has a temperature coefficient that is substantially the same as the temperature coefficient of the first current and a size $I_3$ that is equal to $K_1*I_1$, wherein the fourth current has a temperature coefficient that is substantially the same as the temperature coefficient of the second current and has a size $I_4$ that is equal to $K_2*I_2$, said first output stage further adapted to add the third and fourth currents and pass the added currents through a first output resistor disposed in the first output stage, wherein each of $K_1$ and $K_2$ is a positive number and each is selected such that an output voltage generated across the output resistor has a nearly zero temperature coefficient, wherein each of the first and second voltage gain stages is an operational amplifier, wherein the first current flows through a first node coupled to a positive input terminal of the first operational amplifier and wherein a mirrored replica of the first current flows through a second node coupled to a negative input terminal of the first operational amplifier and wherein the second current flows through a third node coupled to a positive input terminal of the second operational amplifier and wherein a mirrored replica of the second current flows through a fourth node coupled to a negative input terminal of the second operational amplifier.

2. The Integrated Circuit of claim 1 wherein the first closed-loop circuit further comprises a first bipolar transistor having an emitter terminal that is coupled to the positive input terminal of the first operational amplifier, and wherein the second closed-loop circuit further comprises a second bipolar transistor having an emitter terminal that is coupled to the positive input terminal of the second operational amplifier, and wherein the base and collector terminals of the first and second bipolar transistors are coupled to a ground terminal.

3. The Integrated Circuit of claim 2 wherein the first closed-loop circuit further comprises a first resistor having a first terminal coupled to the negative input terminal of the first operational amplifier and a second terminal coupled to an emitter terminal of a third bipolar transistor disposed in the first closed-loop circuit, the third bipolar transistor having base and collector terminals that are coupled to the ground terminal, wherein an emitter area of the third bipolar transistor is N times an emitter area of the first bipolar transistor.

4. The Integrated Circuit of claim 3, wherein the first closed-loop circuit further comprises a first MOS transistor generating the first current and a second PMOS transistor generating the mirrored replica of the first current, wherein a source terminal of each of the first and second MOS transistors is coupled to a positive supply voltage, wherein a gate terminal of each of the first and second MOS transistors is coupled to an output terminal of the first operational amplifier, wherein a drain terminal of the first MOS transistor is coupled to the positive input terminal of the first operational amplifier, and wherein a drain terminal of the second MOS transistor is coupled to the negative input terminal of the first operational amplifier.

5. The Integrated Circuit of claim 4 wherein the second closed-loop circuit further comprises a second resistor having a first terminal coupled to the negative input terminal of the second operational amplifier and a second terminal coupled to the ground terminal.

6. The Integrated Circuit of claim 5 wherein the second closed-loop circuit further comprises a third MOS transistor generating the second current and a fourth MOS transistor generating the mirrored replica of the second current, wherein a source terminal of each of the third and fourth MOS transistors is coupled to a positive supply voltage, wherein a gate terminal of each of the third and fourth MOS transistors is coupled to an output terminal of the second operational amplifier, wherein a drain terminal of the third MOS transistor is coupled to the positive input terminal of the second operational amplifier, and wherein a drain terminal of the fourth MOS transistor is coupled to the negative input terminal of the second operational amplifier.

7. The Integrated Circuit of claim 6 wherein the first output stage further comprises fifth and sixth MOS transistors, wherein a gate terminal of the fifth MOS transistor is coupled to the output terminal of the first operational amplifier, wherein a gate terminal of the sixth MOS transistor is coupled to the output terminal of the second operational amplifier, wherein a source terminal of each of the fifth and sixth MOS transistors is coupled to the first positive voltage supply, and wherein a drain terminal of each of the fifth and sixth MOS transistors is coupled to a first terminal of the output resistor whose second terminal is coupled to the ground terminal, and wherein a ratio of channel-width to channel-length of the fifth MOS transistor is $K_1$ times the ratio of channel-width to channel-length of the first MOS transistor, and wherein a ratio of channel-width to channel-length of the sixth MOS transistor is $K_2$ times the ratio of channel-width to channel-length of the third MOS transistor.

8. The Integrated Circuit of claim 7 further comprising a second output stage, the second output stage comprises seventh and eight MOS transistors and a second output resistor, wherein a gate terminal of the seventh MOS transistor is coupled to the output terminal of the first operational amplifier, wherein a gate terminal of the eight MOS transistor is coupled to the output terminal of the second operational amplifier, wherein a source terminal of each of the seventh and eight MOS transistors is coupled to the first positive voltage supply, and wherein a drain terminal of each of the seventh and eighth MOS transistors is coupled to a first terminal of the second output resistor whose second terminal is coupled to the ground terminal, and wherein a ratio of channel-width to channel-length of the seventh MOS transistor is $K_3$ times the ratio of channel-width to channel-length of the first MOS transistor disposed in the first closed-loop circuit, and wherein a ratio of channel-width to channel-length of the eight MOS transistor is $K_4$ times the ratio of channel-width to channel-length of the third MOS transistor disposed in the second closed-loop circuit, wherein $K_3$ and $K_4$ are selected such that a voltage generated across the second output resistor has a temperature coefficient that is different from the temperature coefficient of the voltage generated across the first output resistor.

9. A method comprising:

generating a first current having a positive temperature coefficient and a size $I_1$;

generating a second current having a negative temperature coefficient and a size $I_2$;

generating a third current that has a temperature coefficient that is substantially the same as the temperature coefficient of the first current and a size $I_3$ that is equal to $K_1*I_1$;

generating a fourth current that has a temperature coefficient that is substantially the same as the temperature coefficient of the second current and has a size $I_4$ that is equal to $K_2*I_2$;

summing the third and fourth currents;

passing the summed current through a first output resistor to generate a first output voltage, wherein each of $K_1$ and $K_2$ is a positive number and each is selected such that the first output voltage has a nearly zero temperature coefficient;

applying the first current to a first node coupled to a positive input terminal of a first operational amplifier:

applying a mirrored replica of the first current to a second node coupled to a negative input terminal of the first operational amplifier; wherein each of the positive input terminal and negative input terminal of the first operational amplifier has a voltage that is one base-to-emitter voltage of a bipolar transistor higher than a ground potential;

applying the second current to a third node coupled to a positive input terminal of a second operational amplifier; and applying a mirrored replica of the second current to a fourth node coupled to a negative input terminal of the second operational amplifier; wherein each of the positive input terminal and negative input terminal of the second operational amplifier has a voltage that is one base-to-emitter voltage of the bipolar transistor higher than the ground potential.

10. The method of claim 9 wherein the positive input terminal of the first operational amplifier is coupled to an emitter terminal of a first bipolar transistor whose base and collector terminals are coupled to a ground terminal, wherein the negative input terminal of the first operational amplifier is coupled to a first terminal of a first resistor whose second terminal is coupled to an emitter terminal of a second bipolar transistor whose base and collector terminals are coupled to the ground terminal, and wherein an area of the emitter of the second bipolar transistor is N times the emitter area of the first bipolar transistor.

11. The method of claim 10 wherein the positive input terminal of the second operational amplifier is coupled to an emitter terminal of a third bipolar transistor whose base and collector terminals are coupled to the ground terminal, wherein the negative input terminal of the first operational amplifier is coupled to a first terminal of a second resistor whose second terminal is coupled to the ground terminal.

12. The method of claim 11 wherein the first current is generated by a first MOS transistor having a source terminal coupled to a positive supply voltage, a gate terminal coupled to an output terminal of the first operational amplifier, and a drain terminal coupled to the positive input terminal of the first operational amplifier, and wherein the mirrored replica of the first current is generated by a second MOS transistor having a source terminal coupled to the positive supply voltage, a gate terminal coupled to the output terminal of the first operational amplifier, and a drain terminal coupled to the negative input terminal of the first operational amplifier.

13. The method of claim 12 wherein the second current is generated by a third MOS transistor having a source terminal coupled to the positive supply voltage, a gate terminal coupled to an output terminal of the second operational amplifier, and a drain terminal coupled to the positive input terminal of the second operational amplifier, and wherein the mirrored replica of the second current is generated by a fourth MOS transistor having a source terminal coupled to the positive supply voltage, a gate terminal coupled to the output terminal of the second operational amplifier, and a drain terminal coupled to the negative input terminal of the second operational amplifier.

14. The method of claim 13 wherein the third current is generated by a fifth MOS transistor having a source terminal coupled to the positive supply voltage, a gate terminal coupled to the output terminal of the first operational amplifier, and a drain terminal coupled to a first terminal of the first output resistor, and wherein the fourth current is generated by a sixth MOS transistor having a source terminal coupled to the positive supply voltage, a gate terminal coupled to the output terminal of the second operational amplifier, and a drain terminal coupled to a first terminal of the first output resistor, wherein a second terminal of the first output resistor is coupled to the ground terminal, and wherein a ratio of channel-width to channel-length of the fifth MOS transistor is $K_1$ times the ratio of channel-width to channel-length of the first MOS transistor, and wherein a ratio of channel-width to channel-length of the sixth MOS transistor is $K_2$ times the ratio of channel-width to channel-length of the third MOS transistor.

15. The method of claim 9 further comprising:

generating a fifth current that has a temperature coefficient that is substantially the same as the temperature coefficient of the first current and a size $I_3$ that is equal to $K_3*I_1$;

generating a sixth current that has a temperature coefficient that is substantially the same as the temperature coefficient of the second current and has a size $I_4$ that is equal to $K_4*I_2$;

summing the fifth and sixth currents; and passing the summed current through a second output resistor to generate a second output voltage, wherein each of $K_3$ and $K_4$ is a positive number and each is selected such that the second output voltage has a temperature coefficient that is different from the temperature coefficient of the first output voltage.

* * * * *